US006189730B1

(12) United States Patent
McClymonds

(10) Patent No.: US 6,189,730 B1
(45) Date of Patent: Feb. 20, 2001

(54) WET TOWELETTE AND DRY TOWEL DISPENSER APPARATUS

(76) Inventor: Arnold J. McClymonds, P.O. Box 697, Cotati, CA (US) 94931

( * ) Notice: Under 35 U.S.C. 154(b), the term of this patent shall be extended for 0 days.

(21) Appl. No.: 09/169,170

(22) Filed: Oct. 7, 1998

Related U.S. Application Data

(60) Provisional application No. 60/061,833, filed on Oct. 14, 1997.

(51) Int. Cl.[7] ..... A47K 10/38

(52) U.S. Cl. ..... 221/46; 221/286; 221/287; 221/197

(58) Field of Search ..... 221/33, 63, 45, 221/46, 61, 62, 197, 287, 286; 225/106, 93, 90

(56) References Cited

U.S. PATENT DOCUMENTS

| | | | | |
|---|---|---|---|---|
| D. 342,635 | | 12/1993 | Carter et al. . | |
| D. 344,830 | | 3/1994 | Carter et al. . | |
| 4,017,002 | | 4/1977 | Doyle et al. . | |
| 4,171,047 | * | 10/1979 | Doyle et al. | 206/210 |
| 4,180,160 | * | 12/1979 | Ogawa et al. | 206/210 |
| 4,524,895 | * | 6/1985 | Lunden | 225/19 |
| 4,534,491 | * | 8/1985 | Norton et al. | 221/63 |
| 4,776,649 | | 10/1988 | Wolde . | |
| 4,984,530 | | 1/1991 | Dutton . | |
| 5,443,084 | | 8/1995 | Saleur . | |
| 5,715,971 | * | 2/1998 | Morand | 221/45 |
| 5,765,718 | * | 6/1998 | Grasso et al. | 221/62 |
| 5,908,138 | * | 6/1999 | Vlahakis et al. | 221/63 |
| 6,062,422 | * | 5/2000 | Ellis | 221/45 |

* cited by examiner

*Primary Examiner*—Christopher P. Ellis
*Assistant Examiner*—Rashmi Sharma
(74) *Attorney, Agent, or Firm*—Douglas E. White

(57) ABSTRACT

The invention comprises a wall or door-mounted container for cleansing wipes having two separate compartments, one for holding readily available packet stacks (or rolls) of dry paper towel wipes of standard size, and one for holding a sealed containers of pre-moistened paper towelette wipes. The latter containers also may be found in retail and wholesale outlets everywhere and comes in generally cylindrical tubs of two or three standard sizes. A slot is provided in the bottom of the first container compartment for permitting egress of the dry paper towels, as is common. A new aperture is provided in the bottom of the second compartment for providing egress to the wet towelettes, in cooperative placement with respect to the cross slit aperture found in the lid of a towelette tub. A one-piece hinged and locked transparent front panel gives ready access to both compartments for instant refilling.

13 Claims, 5 Drawing Sheets

WET TOWELETTE AND DRY TOWEL DISPENSER APPARATUS

CROSS REFERENCE TO RELATED APPLICATIONS

This application claims the benefit of U.S. Provisional Application No. 60/061,833, filed Oct. 14, 1997.

FEDERALLY SPONSORED RESEARCH OR DEVELOPMENT

Not applicable.

FIELD OF THE INVENTION

This invention relates to paper towel containers, more particularly to dual-compartment and single compartment dispenser apparatus for storing and dispensing dry paper towels and/or pre-moistened paper towelettes.

BACKGROUND OF THE INVENTION

It is common to provide a supply of paper towels in public washrooms for use in drying one's hands after washing. Paper towels also are stored in home dispensers for use in cleaning kitchen and toilet surfaces, and for similar washing and drying applications. There are limitations in the usefulness of dry paper towels, however. In particular, they are not very effective for sanitizing and disinfecting dry surfaces contaminated with bacteria and similar micro-biological agents.

More recently, there have become available containers and packets of pre-moistened paper wipes known as towelettes. These are useful in sanitizing one's hands and environmental surfaces because, in addition to containing water (which, of course, helps dissolve contaminants) such pre-moistened towelettes often contain alcohol or other disinfectants. A limitation in the adoption of such towelettes, particularly with respect to their provision in public rest room facilities, is that the moistening agents are particularly volatile. Therefore, the towelettes must be kept in more or less air tight containers until just prior to use.

Complex mechanisms been proposed for holding paper towels and moistening them just prior to dispensing, or simultaneously therewith. Some of these dispense both wet and dry paper products. A problem with such machinery is that it tends to be hard to fill, delicate, expensive, prone to failure, and subject to vandalism—not to mention that it tends to require the stocking of specialized, hard-to-find papers and chemical wetting agents. By the same token, public rest room facilities often are tended by unskilled individuals who have neither the time nor the training to stock and maintain complex electromechanical apparatus for dispensing both dry towels and wet towelettes. Nor do small businesses, many of which are in out-of-the-way locations, want to have to stock exotic and expensive supplies.

There is a need, therefore, for a wipe dispenser that is capable of supplying dry paper towels and/or pre-moistened paper towelettes which is easy to refill and simple to operate, and which uses off-the-shelf supplies that are readily available throughout the country.

Prior developments in this field may be generally illustrated by reference to the following information disclosure statement:

U.S. Patent Documents

| U.S. Pat. No. | Patentee | Issue Date |
|---|---|---|
| 5,443,084 | R. Saleur | Aug. 22, 1995 |
| 4,017,002 | R. Doyle et al. | Apr. 12, 1977 |
| Des. 344,830 | H. Carter et al. | Mar. 1, 1994 |
| 4,984,530 | V. Dutton | Jan. 15, 1991 |
| 4,776,649 | A. ten Wolde | Oct. 11, 1988 |
| Des. 342,635 | H. Carter et al. | Dec. 28, 1993 |

U.S. Pat. No. 5,443,084 describes a container having a plurality of compartments for storing separate sets of dry paper towels and the like. Also included is means for moistening one set of dry towels prior to the dispensing thereof.

U.S. Pat. No. 4,984,530 describes another container that stores separate sets of dry towels and has apparatus for wetting one set as it is dispensed.

U.S. Pat. No. 4,017,002 teaches a portable container for storing and dispensing pre-moistened towelettes. This type of prior-art container may be used within the device of the present invention, as discussed below.

The remaining patents are representative of what was found in a search of the art.

It therefore will be appreciated that there continues to be a need for a new and improved wipe dispenser apparatus which addresses the problems of construction, effectiveness and ease of use that are attendant in the prior art. In this respect, the present invention substantially fulfills this need.

SUMMARY OF THE INVENTION

In view of the disadvantages inherent in the known art, the general purpose of the present invention, which will be described subsequently in greater detail, is to teach a new and improved wet towelette and dry towel dispenser apparatus which has all of the important advantages of the prior art and few, if any, of the disadvantages.

The present invention is a dispenser that may be used to provide wet towelettes for cleaning and disinfecting and dry paper towels for drying. It finds application in sanitizing toilets, baby changing areas, kitchen work surfaces and kitchen utensils, as well as for thoroughly cleaning the user's hands. This dispenser can be used at home, as well as in the public rest rooms and other areas of such commercial establishments as restaurants, day care facilities, hospitals, nursing homes and the like. The pre-moistened towelette wipes made available by this device can be used to kill common germs found on toilet seats, toilet handles, faucet handles, door handles, countertops, bassinets, appliances, and the like. To clean, refresh, sanitize and deodorize an environmental surface, the user need only tear off a pre-moistened towelette from the dispenser, wipe the surface clean, then remove a dry towel and use it to further clean and dry the surface.

The invention preferably comprises a wall or door-mounted wipe container having two separate compartments, one for holding readily available packet stacks (or rolls) of dry paper towels of standard size, and one for holding a re-sealable container of pre-moistened paper towelettes. The latter containers may be found in retail and wholesale outlets everywhere and come in generally cylindrical tubs of two or three standard sizes. A longitudinal slot is provided in the bottom of the first container compartment for permitting egress of the dry paper towels, as is common.

A new aperture is provided in the bottom of the second compartment for providing egress to the wet towelettes, in cooperative placement with respect to the cross slit aperture found in the lid of towelette tubs. Examples of such towelette tubs are sold under the brand name WET ONES, available from Personal Care Group, Inc. of Montvale, N.J., and THICK BABY WIPES from Walgreen Co. of Deerfield, Ill.

A hinged and locked front panel or cover gives ready access to both compartments for instant refilling. A standard switching flap (see Part No. T1966-T1967 from Fort Howard Co. of Green Bay, Wis.) may be included for converting the device from multifold towels to C-fold towels. Other than that, the lock and the hinged front cover are the only moving parts of the dispenser. Hence, the apparatus is very durable as well as easy to install, clean and maintain.

FEATURES AND ADVANTAGES

It is therefore an object of the present invention to provide a new and improved wipe dispensing apparatus which has all, or nearly all, of the advantages of the prior art, while simultaneously overcoming most of the disadvantages normally associated therewith.

It is another object of the present invention to provide a new and improved dispensing apparatus which may be easily and efficiently manufactured and marketed. Parts of the dispensing apparatus disclosed herein may be injection molded and others vacuum molded.

A further object or feature of the present invention is a new and improved dispensing apparatus which is of a durable and reliable construction.

An even further object of the present invention is to provide a novel towel/towelette dispensing apparatus which is susceptible of a low cost of manufacture with regard to both materials and labor, and which accordingly is then susceptible of low prices of sale to the public, thereby making the dispensing apparatus economically available to consumers.

Still another object of the present invention is to provide a novel dispensing apparatus wherein an increased ease of assembly, access, loading, and unloading is permitted relative to the wipe dispenser art.

Another object or feature is a new and improved dispensing apparatus that is easy to use, attractive in appearance and suitable for mass production.

An object of this invention is to provide means for dispensing both dry and wet paper cleaning means from a single dispenser.

Another object is to provide means for securing the dispenser against theft and tampering.

Yet another object or feature is dual compartments which separate and organize the paper products.

Still another feature is towelette aperture means for providing direct egress through the shell of the dispenser from the cross slit opening or aperture of a standard pre-moistened towelette tub-style container.

Yet another feature is transparent cover means for viewing the internal supply of paper products. The entire shell may be constructed of transparent material for this purpose.

Still another feature is a device that can dispense available pre-moistened towelettes that are anti-bacterial, scented, formulated for babies, or otherwise given desirable characteristics available only with towelettes that are dispensed in moistened form.

Other novel features which are characteristic of the invention, as to organization and method of operation, together with further objects and advantages thereof will be better understood from the following description considered in connection with the accompanying drawing, in which preferred embodiments of the invention are illustrated by way of example. It is to be expressly understood, however, that the drawing is for illustration and description only and is not intended as a definition of the limits of the invention. The various features of novelty which characterize the invention are pointed out with particularity in the claims annexed to and forming part of this disclosure. The invention resides not in any one of these features taken alone, but rather in the particular combination of all of its structures for the functions specified.

There has thus been broadly outlined the more important features of the invention in order that the detailed description thereof that follows may be better understood, and in order that the present contribution to the art may be better appreciated. There are, of course, additional features of the invention that will be described hereinafter and which will form additional subject matter of the claims appended hereto. Those skilled in the art will appreciate that the conception upon which this disclosure is based readily may be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the Abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The Abstract is neither intended to define the invention of this application, which is measured by the claims, nor is it intended to be limiting as to the scope of the invention in any way.

Certain terminology and derivations thereof may be used in the following description for convenience in reference only, and will not be limiting. For example, words such as "upward," "downward," "left," and "right" would refer to directions in the drawings to which reference is made unless otherwise stated. Similarly, words such as "inward" and "outward" would refer to directions toward and away from, respectively, the geometric center of a device or area and designated parts thereof. References in the singular tense include the plural, and vice versa, unless otherwise noted.

BRIEF DESCRIPTION OF THE DRAWING

The invention will be better understood and objects other than those set forth above will become apparent when consideration is given to the following detailed description thereof. Such description makes reference to the annexed drawing wherein.

DRAWING REFERENCE NUMERALS

Figure 1:
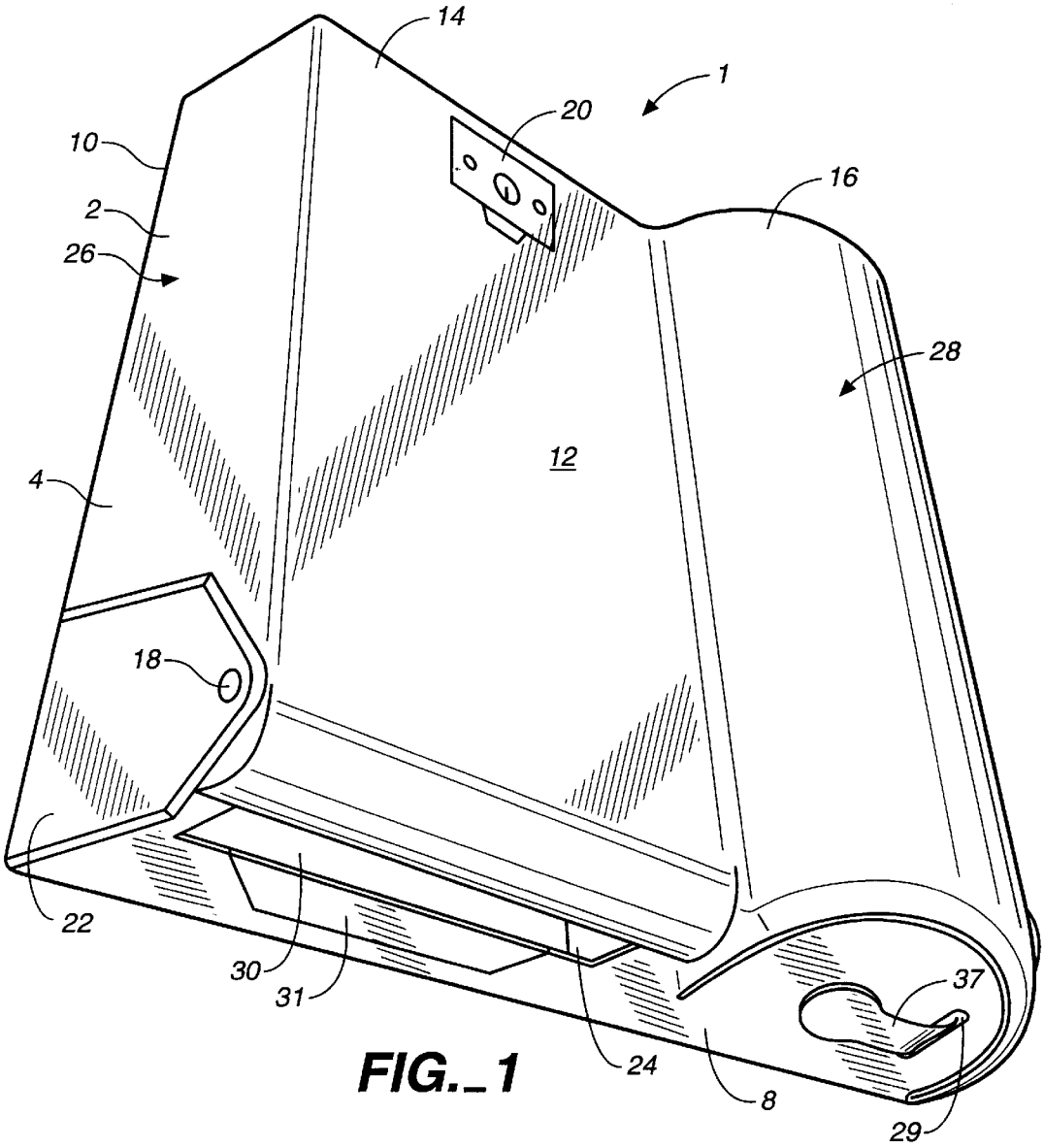
FIG. 1 is is a front perspective view of a preferred dispenser of this invention in a first position.

1 dispenser apparatus
2 shell
4 side wall
6 top
8 bottom
10 back
12 cover
14 planar section
16 cylindrically convex section
18 hinge
20 key latch
22 flange
24 divider wall
26 towel compartment
28 towelette compartment
29 strap slot
30 towel aperture
31 flap
32 towelette aperture
35 tub-containment prong
36 towelette container
37 strap cap
37*a* cap
38 lid
39 cross slit aperture
40 pre-moistened towelette
44 folded towel packet
46 dry towel
101 dispenser apparatus
102 shell
104 side wall
106 top
108 bottom
110 back
112 cylindrically convex cover
118 hinge
120 key latch
128 towelette compartment
129 strap slot
132 towelette aperture
135 tub-containment prong
136 towelette container
137 strap cap
137*a* cap
138 lid
140 pre-moistened towelette
201 dispenser apparatus
202 shell
204 side wall
206 top
208 bottom
210 back
212 cover
214 first cylindrically convex section
216 second cylindrically convex section
218 hinge
220 key latch
224 divider indentation
226 towel compartment
228 towelette compartment
229 strap slot
230 towel aperture
232 towelette aperture
235 tub-containment prong
236 towelette container
237 strap cap
237*a* cap
238 lid
244 towel roll
246 dry towel It is to be noted that, for convenience, the last two positions of the reference numerals of alternative embodiments of the invention duplicate those of the numerals of the embodiment of FIG. 1, where reference is made to similar or corresponding parts. However, it should not be concluded merely from this numbering convention that similarly numbered parts are equivalents.

DETAILED DESCRIPTION OF THE INVENTION

Figure 2:
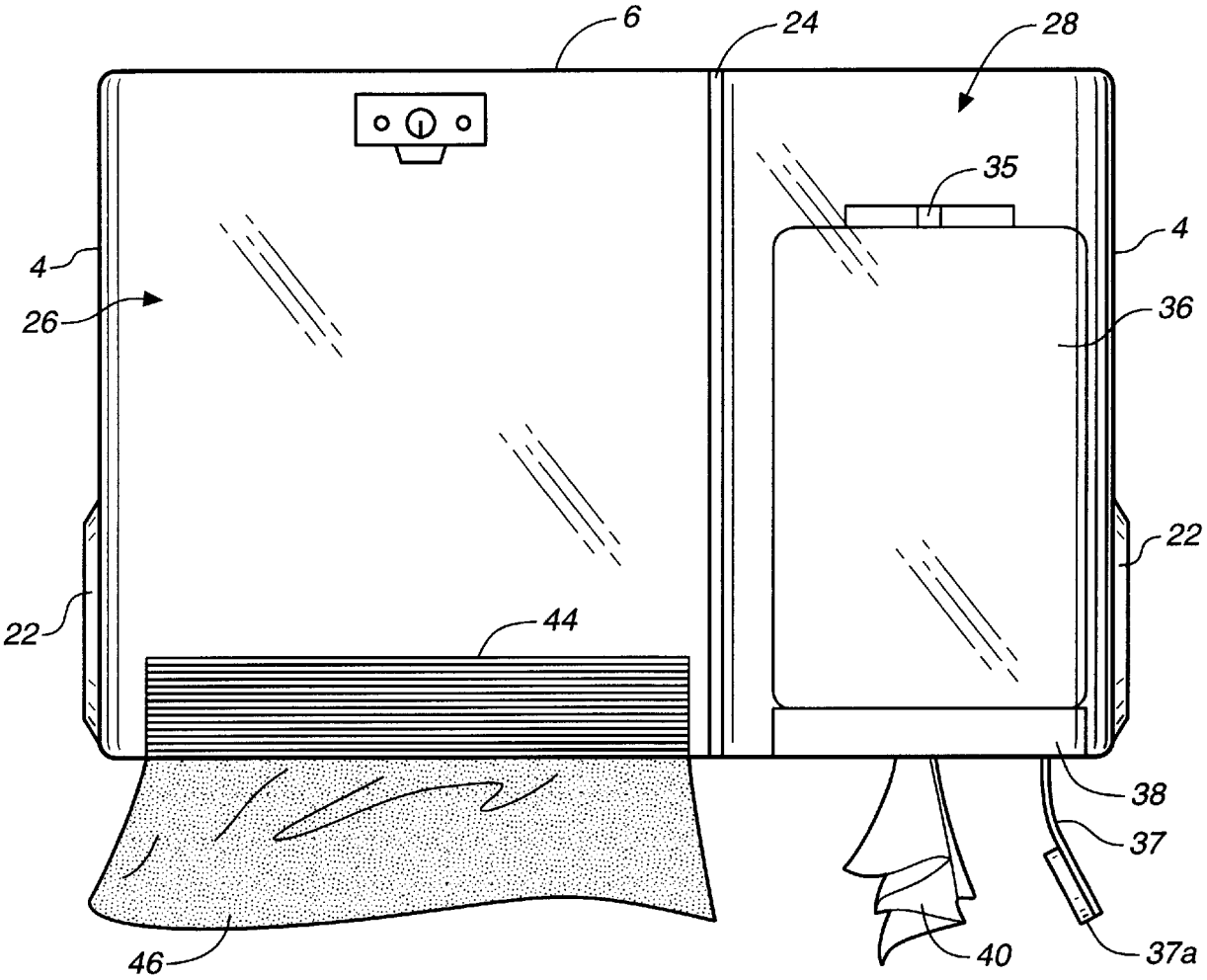
FIG. 2 is a front elevation of the device of FIG. 1.

Referring to FIGS. 1 through 2 generally, there is illustrated therein a first preferred wipe dispenser apparatus 1 of this invention. The dispenser apparatus 1 is principally comprised of a six-sided box-like container shell 2 bounded by two vertical side wall panels 4, a top panel 6, a bottom panel 8, a back panel 10 and a hinged cover 12. Preferably, the cover 12 is fabricated, at least partially, out of transparent plastic so that the need for re-supply may be quickly gauged. The remainder of the shell 2 may be fabricated out of transparent plastic, opaque plastic or metal.

The cover 12 is comprised of two sections—a generally flat or planar section 14 and a cylindrically convex section 16. The cylindrically convex shape of section 16 acts to conform to and hold in place a standard cylindrical towelette tub or container 36. Hinges 18 attach the cover 12 to the side walls 4, preferably at the bottom of the shell 2 so that the cover 12 may be opened by rotating it downward. A key latch 20 provides secure access to the interior of the wipe dispenser apparatus 1. A pair of horizontal brackets or flanges 22 fixed to the back 10 provide support to the hinges 18.

Preferably, a vertical divider wall 24 extends up from the mid-portion of the bottom 8, through the interior of the shell 2, and attaches to the top 6 and the back 10. The divider wall 24 comprises means physically dividing the hollow interior of the shell 2 into two compartments: a first or dry towel compartment 26 and a second or pre-moistened towelette compartment 28.

A longitudinal slot comprising a towel aperture 30 is formed through the bottom 8 below the towel compartment 26. A towelette aperture 32, preferably circular in outline, is formed in the bottom 8 below the towelette compartment 28. The cylindrically convex section 16 of the cover 12 forms the front of the towelette compartment 28 and the planar section 14 of the cover forms the front of the towel compartment 26.

The towelette compartment 28 is of a size and shape conforming to a standard cylindrical towelette tub or container 36. Such tubs have a cross slit aperture 39 for dispensing a continuous perforated strip or web of pre-moistened towelettes 40, which slit aperture is formed in the center of the tub's lid 38. When the towelette container 36 is inserted lid down into the towelette compartment 28, the tub's cross slit 39 directly overlays the towelette aperture 32 so that the pre-moistened towelettes 40 have direct egress from the tub 36 through the shell 2 of the dispenser apparatus 1.

Figure 1A:
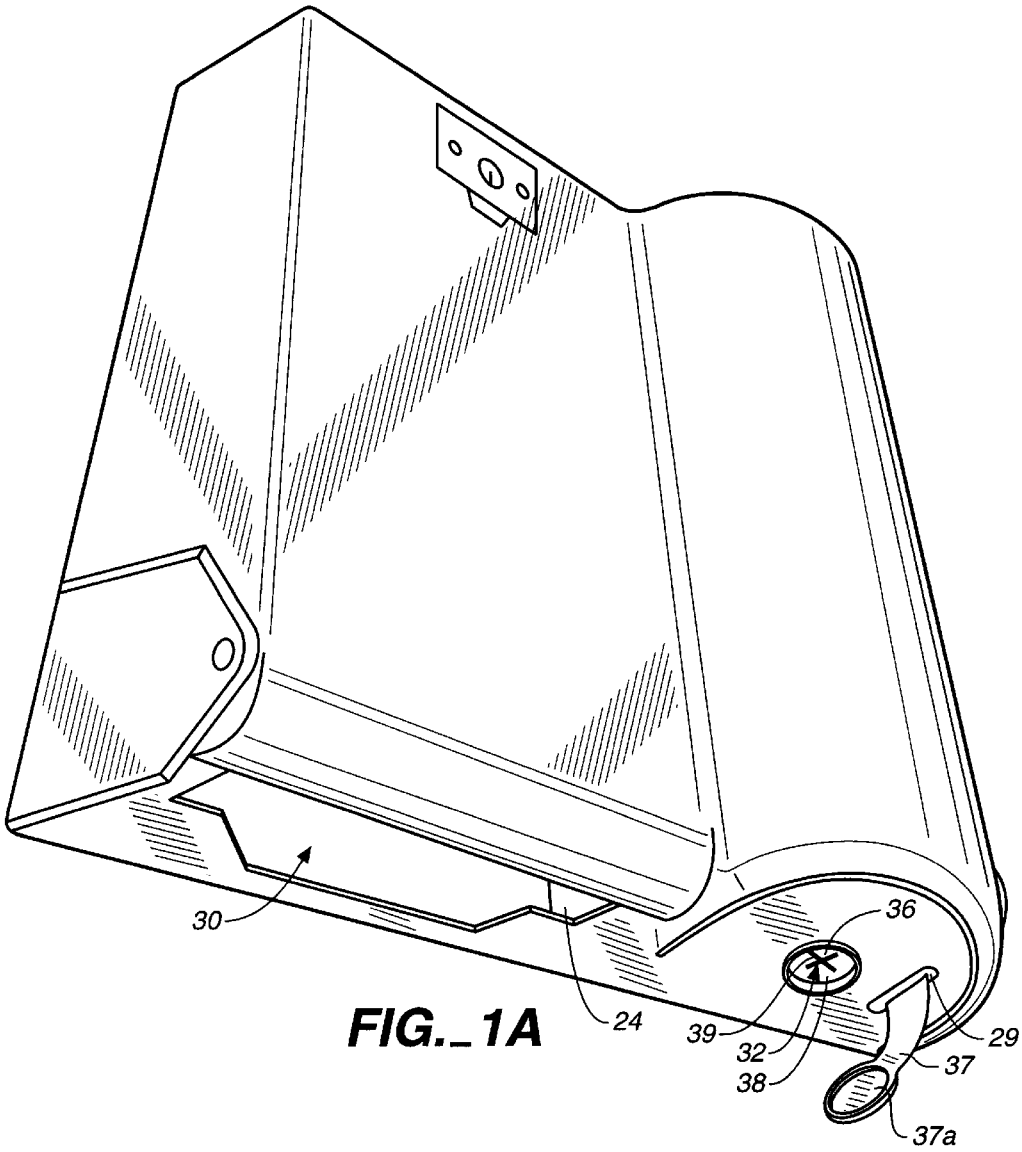
FIG. 1A is a front perspective view of the dispenser of FIG. 1 having the conversion flap and the tub's strap cap in second positions.

In the manner of prior art dry paper dispensers, a folded towel packet 44 (multifold or C-fold towels) may be placed in the towel compartment 26 directly over the towel aperture 30 in order that dry towels 46 may have direct egress from the wipe dispenser apparatus 1. FIG. 1A shows the device with a flap 31 rotated in a down position for handling multifold dry towels. In FIG. 1, the flap 31 is in an up position, out of sight, for handling C-fold dry towels.

The compartment divider wall 24 keeps the tub 36 centered over the towelette aperture 32 and keeps the towel packet 44 centered over the slot or towel aperture 30.

To use the dispenser apparatus 1 one need merely pull a dry towel 46 out of the towel aperture 30 or pull a pre-moistened towelette 40 out of the towelette aperture 32 (FIG. 2). When either compartment 26, 28 is empty, it may be restocked by untrained personnel with inexpensive supplies that are universally available.

A second slot, namely, a strap slot 29 is formed transversely in the towelette compartment 28. This is used to allow egress to a strap cap 37 of conventional design, which strap terminates in a cap 37a and is affixed to the lid 38 of the towelette container 36. In FIG. 1, the cap of the strap cap 37 is snapped in place back in through the towelette aperture 32 and over the cross slit aperture 39 of the prior art tub 36, keeping the moist towelettes therein dry prior to use. FIGS. 1A and 2 show the strap cap 37 in a second or open position, allowing the pre-moistened towelette 40 web to be accessed by the user. The opposing far peripheries of the towelette aperture 32 and the strap slot 29 are separated by a distance which is about the length of the strap cap 37.

FIG. 2 also shows a flexible rod or barbed tub-containment prong 35, which is used to press the towelette container 36 firmly against the bottom 8 of the towelette compartment 28 to keep it from moving while a pre-moistened towelette 40 is being torn from its web. While the tub-containment prong 35 may be of any of a number of shapes, a better view of a preferred shape may be seen in FIG. 3, which illustrates a second preferred embodiment of the invention.

Figure 3:
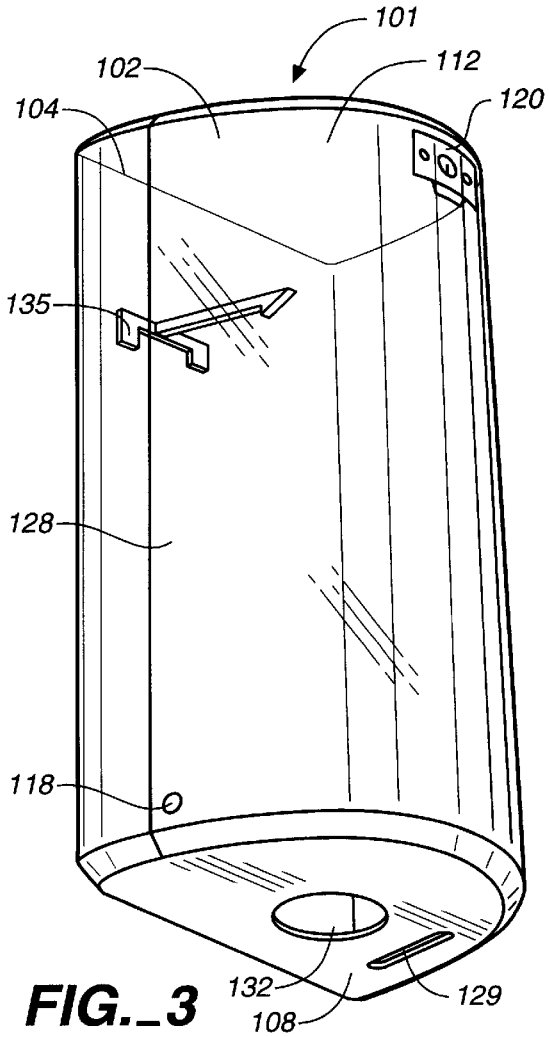
FIG. 3 is a front perspective view of a second preferred dispenser of this invention.
Figure 4:
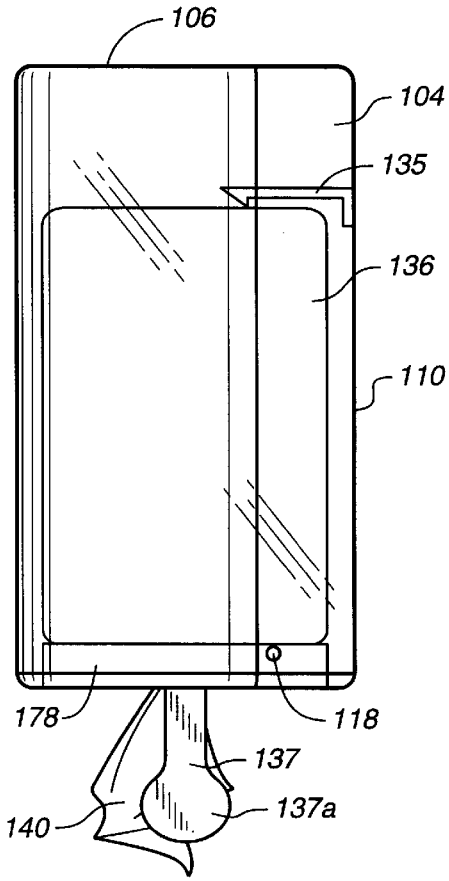
FIG. 4 is a right side elevation of the device of FIG. 3.

Referring next to FIGS. 3 and 4, there is illustrated therein a second preferred wipe dispenser apparatus 101 of this invention. The dispenser apparatus 101 is principally comprised of a semi-cylindrical container shell 102 bounded by two vertical side wall panels 104, a top panel 106, a bottom panel 108, aback panel 110 and a hinged cylindrically convex cover 112. Preferably, the cover 112 is fabricated, at least partially, out of transparent plastic. The remainder of the shell 102 may be fabricated out of transparent plastic, opaque plastic or metal.

Hinges 118 attach the cover 112 to the side walls 104 so that the cover 112 may be opened by rotating it downward. A key latch 120 provides secure access to the interior of the dispenser apparatus 101, namely, to a pre-moistened towelette compartment 128.

A circular towelette aperture 132 is formed in the bottom 108. The cylindrically convex cover 112 forms the front of the towelette compartment 128. The towelette compartment 128 is of a size and shape conforming to a standard cylindrical towelette tub or container 136 for dispensing a continuous perforated strip or web of pre-moistened towelettes 140. When the towelette container 136 is inserted, with its lid 138 down, into the towelette compartment 128, the tub's cross slit directly overlays the towelette aperture 132 so that the pre-moistened towelettes 140 have direct egress.

A strap slot 129 is formed transversely in the towelette compartment 128. This is used to allow egress to a strap cap 137 of conventional design, which strap terminates in a cap 137*a* and is affixed to the lid 138 of the towelette container 136. The cap of the strap cap 137 is snapped in place back in through the towelette aperture 132 and over the cross slit aperture (not illustrated) of the prior art tub 136, keeping the moist towelettes therein dry prior to use.

FIGS. 2 and 3 also show a flexible rod or barbed tub-containment prong 135, which is used to press the towelette container 136 firmly against the bottom 108 of the towelette compartment 128 to keep it from moving while a pre-moistened towelette 140 is being torn from its web. To use the wipe dispenser apparatus 101 one need merely pull a pre-moistened towelette 140 out of the towelette aperture 132 (FIG. 4).

Figure 5:
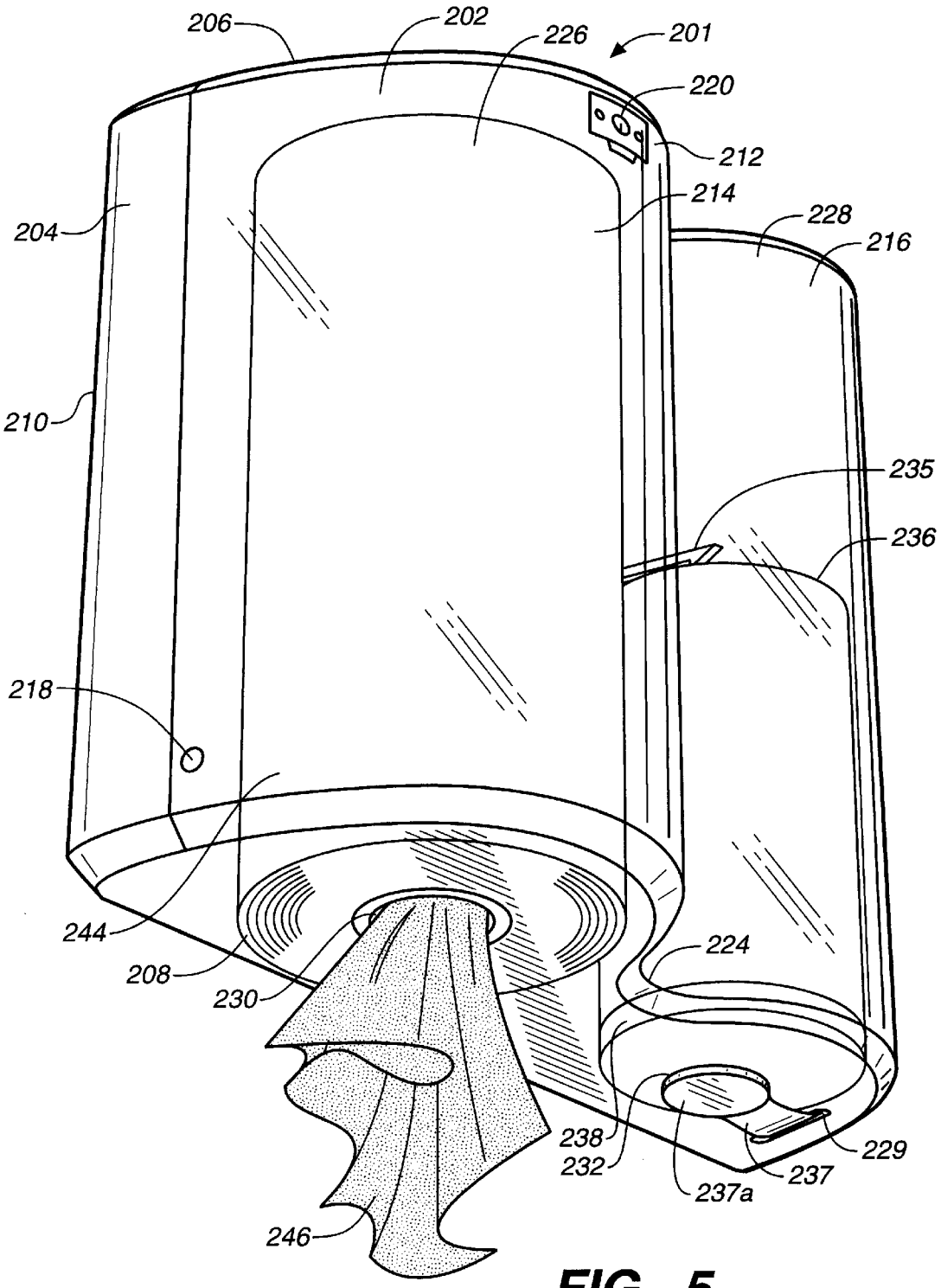
FIG. 5 is a front perspective view of a third preferred dispenser of this invention.

Referring lastly to FIG. 5, there is illustrated therein a third preferred wipe dispenser apparatus 201. The dispenser apparatus 201 is principally comprised of a box-like container shell 202 bounded by two vertical side wall panels 204, a top panel 206, a bottom panel 208, a back panel 210 and a hinged double cylindrically convex cover 212. Preferably, the shell 202 and cover 212 are fabricated, at least partially, out of transparent plastic.

The cover 212 is comprised of two sections, a first cylindrically convex section 214 and a second cylindrically convex section 216. Hinges 218 attach the cover 212 to the side walls 204 so that the cover 212 may be opened by rotating it downward. A key latch 220 provides secure access to the interior of the wipe dispenser apparatus 201.

Preferably, a vertical divider indentation 224 of the cover 212 extends up from the mid-portion of the bottom 8, toward the interior of the shell 2, and touches the top 6. The generally cylindrically concave divider indentation 224, though not extending all the way to the back 210, effectively comprises means physically dividing the hollow interior of the shell 202 into two compartments: a first or dry towel compartment 226 and a second or pre-moistened towelette compartment 228.

A circular dry towel aperture 230 is formed through the bottom 208 below the towel compartment 226. A circular towelette aperture 232 is formed in the bottom 208 below the towelette compartment 228. The towel compartment 226 is of a size and shape designed to contain a towel roll 244 of conventional size and shape. Dry towels 246 are dispensed from the towel aperture 230.

The towelette compartment 228 is of a size and shape conforming to a standard cylindrical towelette tub or container 236 for dispensing a continuous perforated web of pre-moistened towelettes. When the towelette container 236 is inserted, with its lid 238 down, into the towelette compartment 228, the tub's cross slit directly overlays the towelette aperture 232 so that the pre-moistened towelettes have direct egress.

A strap slot 229 is formed transversely in the towelette compartment 228. This is used to allow egress to a strap cap 237, which strap terminates in a cap 237*a* and is affixed to the lid 238 of the towelette container 236. A flexible rod or barbed tub-containment prong 235 is used to press the towelette container 236 firmly against the bottom 208 of the towelette compartment 228.

As to the manner of usage and operation of the instant invention, the same should be apparent from the above disclosure, and accordingly no further discussion relative to the manner of usage and operation of the instant invention need be provided.

The above disclosure is sufficient to enable one of ordinary skill in the art to practice the invention, and provides the best mode of practicing the invention presently contemplated by the inventor. While there is provided herein a full and complete disclosure of the preferred embodiments of this invention, it is not desired to limit the invention to the exact construction, dimensional relationships, and operation shown and described. Various modifications, alternative constructions, changes and equivalents will readily occur to those skilled in the art and may be employed, as suitable, without departing from the true spirit and scope of the invention. Such changes might involve alternative materials, components, structural arrangements, sizes, shapes, forms, functions, operational features or the like. For example, the cover could be hinged on one side so as to swing open horizontally (in the manner of a door) rather than vertically. As another example, the cover could simply pull away from the shell when unlatched. However, this would be equivalent to a hinged attachment, in that it would achieve the same result (access to the interior) in substantially the same way (movement of the cover).

Therefore, the above description and illustrations should not be construed as limiting the scope of the invention, which is defined by the appended claims.

What is claimed is:

1. A wipe dispenser apparatus for holding at least a wet towelette container tub of the type having a cap strap terminating in a cap, including:

a shell having a hollow interior;

a cover forming the front of the shell;

at least one hinge connecting the cover to the remainder of the shell;

a bottom of the shell;

a towelette aperture in the bottom;

and a strap slot in the bottom, the towelette aperture and the strap slot configured so that a cap strap can be threaded out through the strap slot and its cap placed back in through the towelette aperture.

2. The apparatus of claim 1 wherein:

at least one section of the cover is cylindrically convex.

3. The apparatus of claim 2 further including:

a tub-containment prong affixed in the shell.

4. The apparatus of claim 3 further including:

a key latch holding the cover.

5. The apparatus of claim 3 wherein:

at least part of the shell is transparent plastic.

6. The apparatus of claim 5 wherein:

the interior of the shell is divided into two compartments and further including a towel aperture in the bottom.

7. A wipe dispenser apparatus for holding dry paper towels and a cylindrical wet towelette container tub of the type having a cap strap terminating in a cap, including:

a shell having a hollow interior;

a cover forming the front of the shell;

at least one hinge connecting the cover to the remainder of the shell;

means physically dividing the interior into a towel compartment and a towelette compartment, a section of the cover in front of the towelette compartment being cylindrically convex;

a bottom of the shell;

a towelette aperture in the bottom below the towelette compartment;

a strap slot in the bottom, the towelette aperture and the strap slot configured so that a cap strap can be threaded out through the strap slot and its can placed back in through the towelette aperture;

and a towel aperture in the bottom below the towel compartment.

8. The apparatus of claim 7 further including:

a cylindrical towelette container tub in the towelette compartment.

9. The apparatus of claim 8 further including:

a tub-containment prong affixed in the towelette compartment of the shell.

10. The apparatus of claim 9 further including:

a key latch holding the cover.

11. The apparatus of claim 10 wherein:

at least part of the cover is transparent plastic.

12. The apparatus of claim 7 wherein:

the towel aperture is a longitudinal slot and the dividing means includes a divider wall extending vertically in the shell above the bottom.

13. The apparatus of claim 12 wherein:

the towel aperture is circular and the dividing means includes a generally cylindrically concave divider indentation formed in the cover.

* * * * *